US007909318B2

(12) United States Patent
Kim et al.

(10) Patent No.: US 7,909,318 B2
(45) Date of Patent: Mar. 22, 2011

(54) IMAGE FORMING APPARATUS

(75) Inventors: Hak Kyum Kim, Seoul (KR); Byeong Hwa Ahn, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 217 days.

(21) Appl. No.: 12/260,411

(22) Filed: Oct. 29, 2008

(65) Prior Publication Data

US 2009/0174133 A1 Jul. 9, 2009

(30) Foreign Application Priority Data

Jan. 9, 2008 (KR) ..... 10-2008-0002562

(51) Int. Cl.
*B65H 3/44* (2006.01)

(52) U.S. Cl. ..... 271/9.13; 271/9.11; 271/9.07

(58) Field of Classification Search ..... 271/9.07, 271/9.13, 9.11
See application file for complete search history.

(56) References Cited

U.S. PATENT DOCUMENTS 4,896,871 A * 1/1990 Idenawa ..... 271/9.09
4,991,830 A * 2/1991 Yamanaka ..... 271/9.08
5,346,197 A * 9/1994 Takano et al. ..... 271/9.05
5,651,623 A * 7/1997 Stodder et al. ..... 400/605
5,695,182 A * 12/1997 Sekine ..... 271/9.09
5,727,890 A * 3/1998 Stodder et al. ..... 400/624
5,738,454 A * 4/1998 Zepeda et al. ..... 400/625
5,957,447 A * 9/1999 Sekine ..... 271/9.09
6,179,499 B1 * 1/2001 Beretta et al. ..... 400/605
6,227,533 B1 * 5/2001 Jang ..... 271/109
6,406,201 B1 * 6/2002 Beretta et al. ..... 400/605
7,556,255 B2 * 7/2009 Terashima et al. ..... 271/9.07
2004/0130089 A1 * 7/2004 Suzuki et al. ..... 271/9.01
2005/0286942 A1 * 12/2005 Terashima et al. ..... 399/361
* cited by examiner

*Primary Examiner* — Stefanos Karmis
*Assistant Examiner* — Howard Sanders
(74) *Attorney, Agent, or Firm* — Stanzione & Kim, LLP

(57) ABSTRACT

An image forming apparatus capable of preventing simultaneous delivery of two sheets of paper when they are supplied from a paper supply device, thereby improving operational reliability of the paper supply device. The image forming apparatus includes a body incorporating a printing device, a first paper supply unit, in which first paper is loaded, a second paper supply unit, on which second paper is disposed, at least one feed roller to deliver the second paper disposed on the second paper supply unit, a pickup roller to pick up the first paper from the first paper supply unit, and a pickup pad, which is located at a first position to contact the pickup roller when the pickup roller picks up the first paper from the first paper supply unit, and which is located at a second position spaced apart from the pickup roller when the second paper disposed on the second paper supply unit is delivered by the feed roller.

16 Claims, 7 Drawing Sheets

IMAGE FORMING APPARATUS

CROSS-REFERENCE TO RELATED APPLICATION

This application claims the benefit of Korean Patent Application No. 2008-0002562, filed on Jan. 9, 2008 in the Korean Intellectual Property Office, the disclosure of which is incorporated herein by reference.

BACKGROUND OF THE INVENTION

1. Field of the Invention

The present invention relates to an image forming apparatus, and, more particularly, to an image forming apparatus having improved configuration of a paper supply device.

2. Description of the Related Art

An image forming apparatus is an apparatus to form an image on a printing medium. Examples of the image forming apparatus include, e.g., printers, copiers, facsimiles, and devices with some combination of functions of these.

An image forming apparatus includes a paper supply device to supply a printing medium (hereinafter, referred to as "paper" for convenience of description, but the present invention is not limited to paper) to a printing unit of the image forming apparatus.

The paper supply device includes a paper loading member, in which paper is loaded. The paper loading member generally takes the form of a cassette or a tray. The paper supply cassette can hold a plurality of sheets of paper therein, and is frequently used in an automatic paper supply mechanism. The paper supply tray conveniently supplies a sheet of paper or a special sheet of paper, and is frequently used as a manual paper supply mechanism.

FIG. 1 illustrates an example of an image forming apparatus having both a paper supply cassette and paper supply tray. As shown in FIG. 1, the image forming apparatus 1 includes a paper supply cassette 2 detachably mounted to a lower portion of a body 1*a*, and a paper supply tray 3 arranged above, and in parallel with, the paper supply cassette 2.

The paper supply tray 3 is arranged in the body 1*a*, and the body 1*a* has a paper input opening 4 through which a single sheet of paper can be placed on the paper supply tray 3.

The image forming apparatus 1 further includes a pickup roller 5 located above the paper supply cassette 2 and paper supply tray 3 and a pickup pad 6 disposed opposite the pickup roller 5 designed to prevent simultaneous delivery of two sheets of paper.

The pickup roller 5 is commonly used to pick up paper loaded in both the paper supply cassette 2 and paper supply tray 3. More specifically, when a printing operation is performed using the paper supply cassette 2 as shown in FIG. 1A, the pickup roller 5 picks up paper P1 loaded in the paper supply cassette 2 sheet by sheet. Also, when a printing operation is performed using a paper supply tray 3 as shown in FIG. 1B, the pickup roller 5 picks up paper P2 placed on the paper supply tray 3.

The above-described image forming apparatus 1 has an advantage of reducing the size of the apparatus as a result of arranging the paper supply cassette 2 and paper supply tray 3 in parallel. However, there is a risk that the paper loaded in the paper supply cassette 2 can be picked up by the pickup roller 5 even when it is intended to perform a printing operation using the paper supply tray 3, resulting in a simultaneous delivery of two sheets of paper.

For example, a printing operation using the paper supply cassette 2 frequently causes a situation, in which the paper P1 loaded in the paper supply cassette 2 is caught between the pickup roller 5 and the pickup pad 6 as shown in FIG. 1C. If the paper P2 is supplied from the paper supply tray 3 in this state, the paper P1 and paper P2 are picked up together by rotation of the pickup roller 5, thereby being delivered together.

BRIEF DESCRIPTION OF THE DRAWINGS

Various aspects and advantages of the embodiments of the invention will become apparent and more readily appreciated from the following description of the embodiments, taken in conjunction with the accompanying drawings, of which.

DETAILED DESCRIPTION OF SEVERAL EMBODIMENTS

Figure 1A:
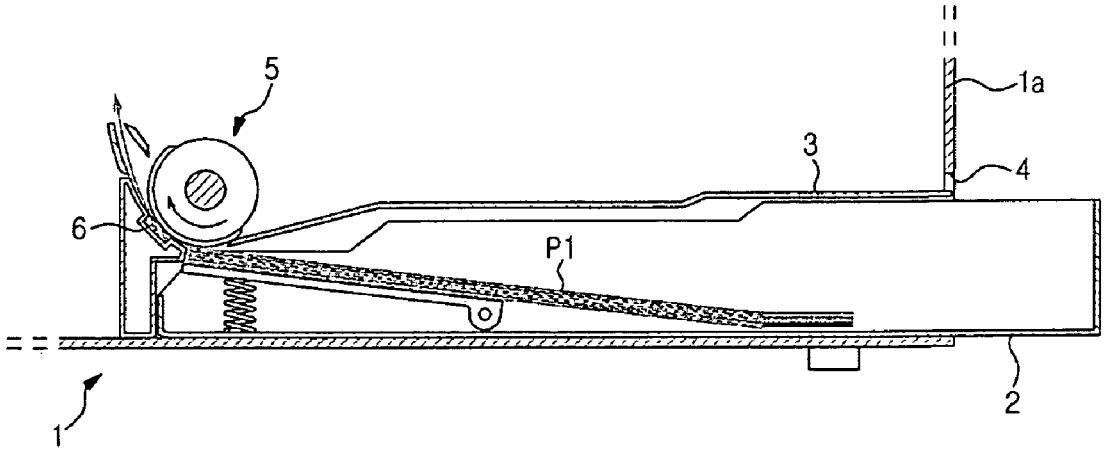
FIGS. 1A-1C are views schematically illustrating a conventional image forming apparatus having both a paper supply cassette and a paper supply tray.
Figure 1B:
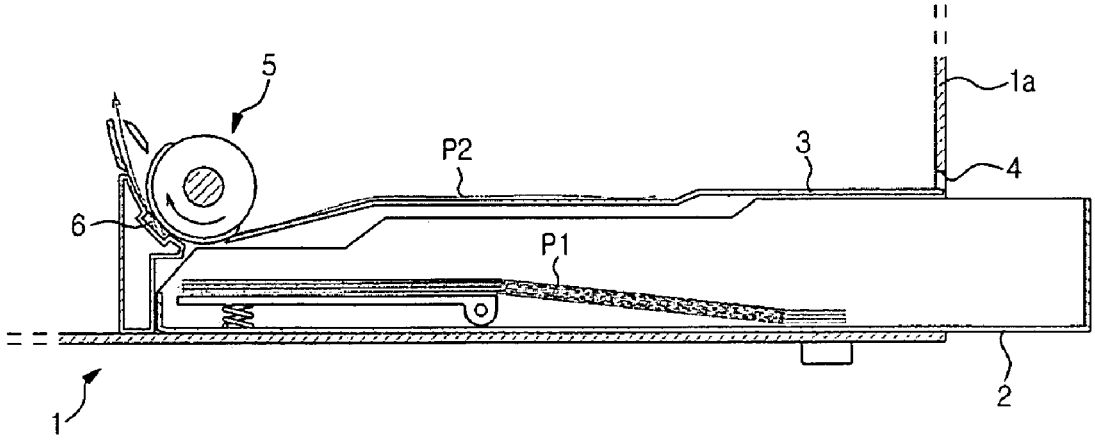
Figure 1C:
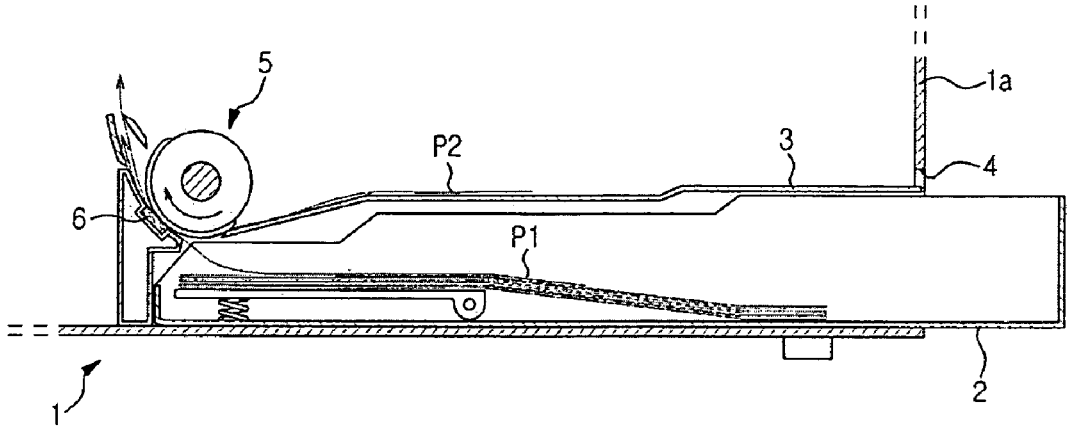

Reference will now be made in detail to exemplary embodiments of the present invention, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be noted that in the drawings, the dimensions of the features are not intended to be to true scale, and may be exaggerated for the sake of allowing greater understanding.

Figure 2:
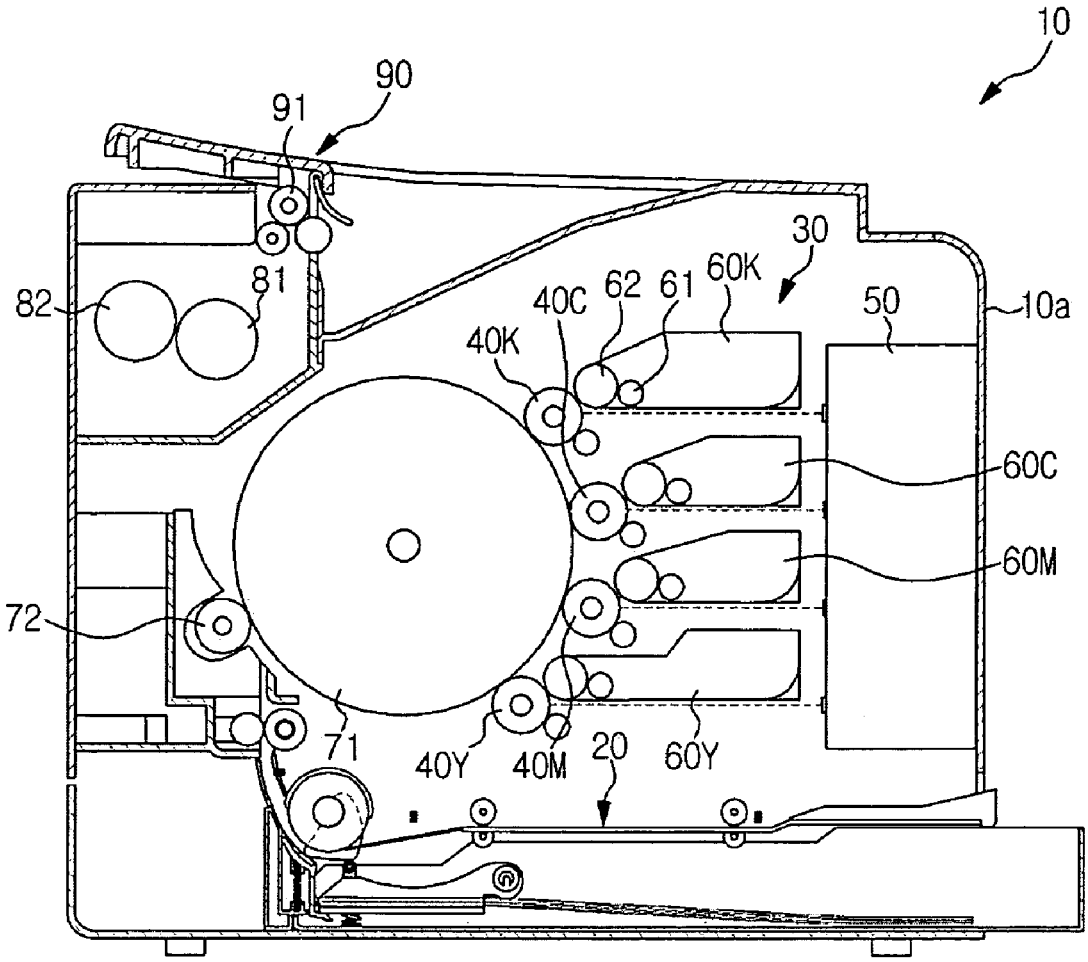
FIG. 2 is a view illustrating a configuration of an image forming apparatus according to an embodiment of the present invention.

FIG. 2 shows an illustrative example of an image forming apparatus according to an embodiment of the present invention. As shown in FIG. 2, the image forming apparatus 10 includes a body 10*a*, a paper supply device 20, a printing device 30, and a paper discharge device 90.

The printing device 30 prints an image on paper supplied from the paper supply device 20. The image forming apparatus of this example is an electro-photographic type color image forming apparatus, and the printing device 30 includes photosensitive members 40K, 40C, 40M, and 40Y, a light scanning device 50, a developing device 60, a transfer device 70, and a fixing device 80. It should be apparent however, the present embodiment is not so limited to any particular type of image forming apparatus, and could be practiced in any image forming apparatus that uses print medium for recording visual images.

The body 10*a* defines the overall external appearance of the image forming apparatus, and supports a variety of elements installed therein.

The paper supply device 20 supplies paper to the printing device 30. A detailed description of the paper supply device 20 will follow.

The light scanning device 50 irradiates light beams, corresponding to image information, to the photosensitive members 40K, 40C, 40M, and 40Y, to form electrostatic latent images on the surfaces of the photosensitive members 40K, 40C, 40M, and 40Y.

The developing device 60 supplies toner to the electrostatic latent images formed on the photosensitive members 40K, 40C, 40M, and 40Y, so as to form visible images. The developing device 60 may include four developers 60K, 60C, 60M, and 60Y, each of which receive toner of different color, for example, black toner K, cyan toner C, magenta toner M, and yellow toner Y, respectively.

Each of the developers 60K, 60C, 60M, and 60Y may include a feed roller 61 and a developing roller 62. The feed roller 61 supplies toner to the developing roller 62, and the developing roller 62 supplies the toner to the associated photosensitive member so as to develop the electrostatic latent image into the visible image.

The transfer device 70 may include an intermediate transfer drum 71 and a transfer roller 72. The visible images formed on the photosensitive members 40K, 40C, 40M, and 40Y are sequentially transferred to the intermediate transfer drum 71 such that they overlap one another. The resulting overlapped color image is transferred to paper, which passes through a gap between the transfer roller 72 and the intermediate transfer drum 71.

The paper, having passed through the transfer device 70, is introduced to the fixing device 80. The fixing device 80 may include a heating roller 81 and a pressing roller 82. While the paper medium, to which the image was transferred, passes through the gap between the heating roller 81 and the pressing roller 82, the image is fixed to the paper by heat and pressure.

The paper, having passed through the fixing device 80, is guided to the paper discharge device 90, and in turn, is discharged from the body 10*a* by a discharge roller 91.

Figure 3:
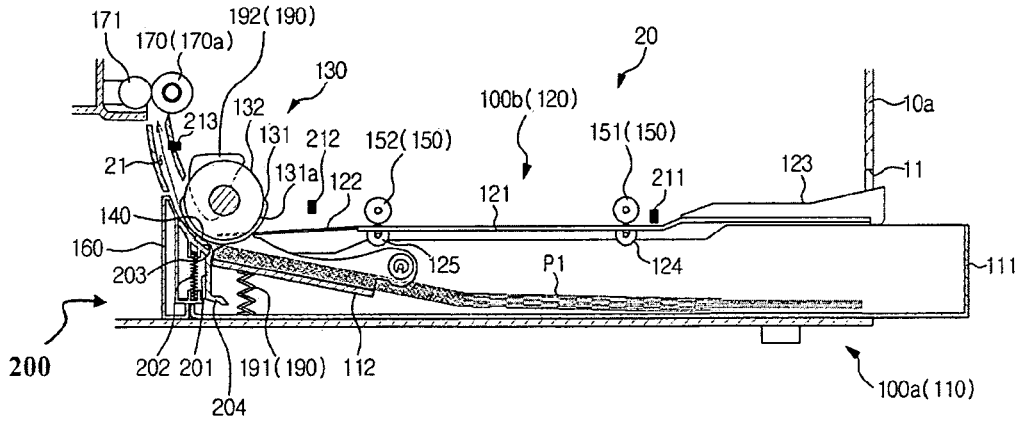
FIG. 3 is a view illustrating supply of paper from a first paper supply unit of the image forming apparatus of FIG. 2.
Figure 4:
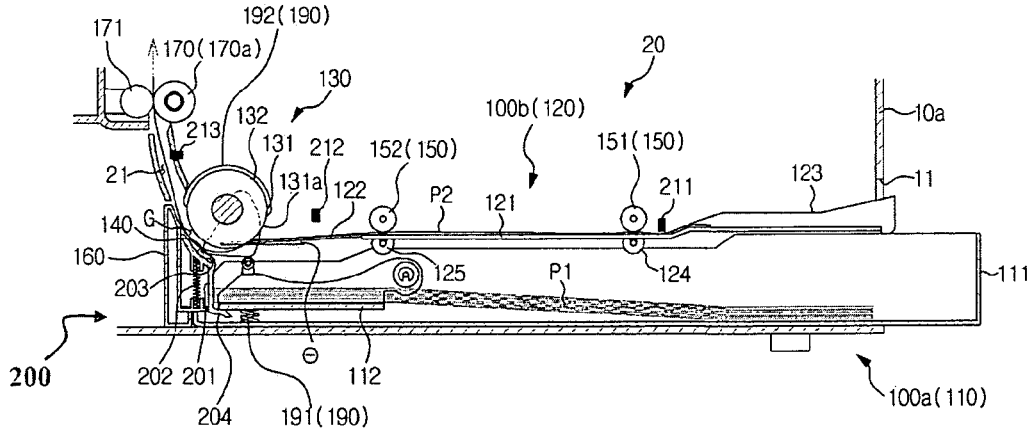
FIG. 4 is a view illustrating supply of paper from a second paper supply unit of the image forming apparatus of FIG. 2.

FIG. 3 is a view illustrating supply of paper from a first paper supply unit provided in the image forming apparatus of FIG. 2. FIG. 4 is a view illustrating supply of paper from a second paper supply unit provided in the image forming apparatus of FIG. 2.

As shown in FIGS. 3 and 4, the paper supply device 20 includes a first paper supply unit 100*a*, in which a plurality of sheets of paper P1 can be loaded, and a second paper supply unit 100*b*, which allows a user to manually supply a sheet of paper P2. Hereinafter, paper loaded in the first paper supply unit 100*a* is referred to as first paper P1, and paper disposed on the second paper supply unit 100*b* is referred to as second paper P2.

When no second paper P2 is disposed on the second paper supply unit 100, the image forming apparatus 10 performs a printing operation by supplying the first paper P1, loaded in the first paper supply unit 100*a*, to the printing device 30. When the second paper P2 is put on the second paper supply unit 100*b*, the image forming apparatus 10 performs a printing operation by supplying the second paper P2 to the printing device 30.

The first paper supply unit 100*a* may take the form of a paper supply cassette 110 detachably mounted to the body 10*a*.

The second paper supply unit 100*b* may take the form of a paper supply tray 120 mounted in the body 10*a*. The paper supply tray 120 is located close to the paper supply cassette 110 above the paper supply cassette 110. The body 10*a* has a paper input opening 11 through which paper can be placed on the paper supply tray 120.

In the case where the first paper supply unit 100*a* and second paper supply unit 100*b* are arranged in parallel, the first paper P1 and second paper P2 can be delivered to the printing device 30 along the same paper supply path 21, and various supply elements in the paper supply path can be shared by the first paper P1 and the second paper P2. This may advantageously reduce the size of the image forming apparatus 10.

The paper supply device 20 may include a pickup roller 130, a pickup pad 140, at least one feed roller 150, a pickup guide 160, and a delivery roller 170. The pickup roller 130 picks up the first paper P1 loaded in the paper supply cassette 110 and delivers it to the paper supply path 21. The pickup pad 140 is disposed opposite the pickup roller 130 and is used to pick up the first paper P1 sheet by sheet. The feed roller(s) 150 delivers the second paper P2, disposed on the paper supply tray 120, along the paper supply path 21. The pickup guide 160 guides the first paper P1 or second paper P2 to be delivered to the paper supply path 21. The delivery roller 170 is located between the pickup roller 130 and the printing device 30.

When the first paper P1 is picked up from the paper supply cassette 110, the pickup pad 140 is brought into contact with the pickup roller 130 as shown in FIG. 3. However, when the second paper P2 is supplied from the paper supply tray 120, the pickup pad 140 is spaced apart from the pickup roller 130, to have a gap G with the pickup roller 130 as shown in FIG. 4.

As shown in FIG. 4, the second paper P2, which is delivered by the feed roller(s) 150, can be moved to the delivery roller 170 by passing through the gap G. Therefore, even if the second paper P2 is supplied from the paper supply tray 120 in a state wherein the first paper P1 is caught between the pickup roller 130 and the pickup pad 140, there is less likelihood of paper P1 and P2 being simultaneously delivered to the printing device 30.

Hereinafter, the position of the pickup pad 140 when the pickup pad 140 comes into contact with the pickup roller 130 is referred to as the first position, and the position of the pickup pad 140 when the pickup pad 140 is spaced apart from the pickup roller 130 is referred to as the second position.

Figure 5:
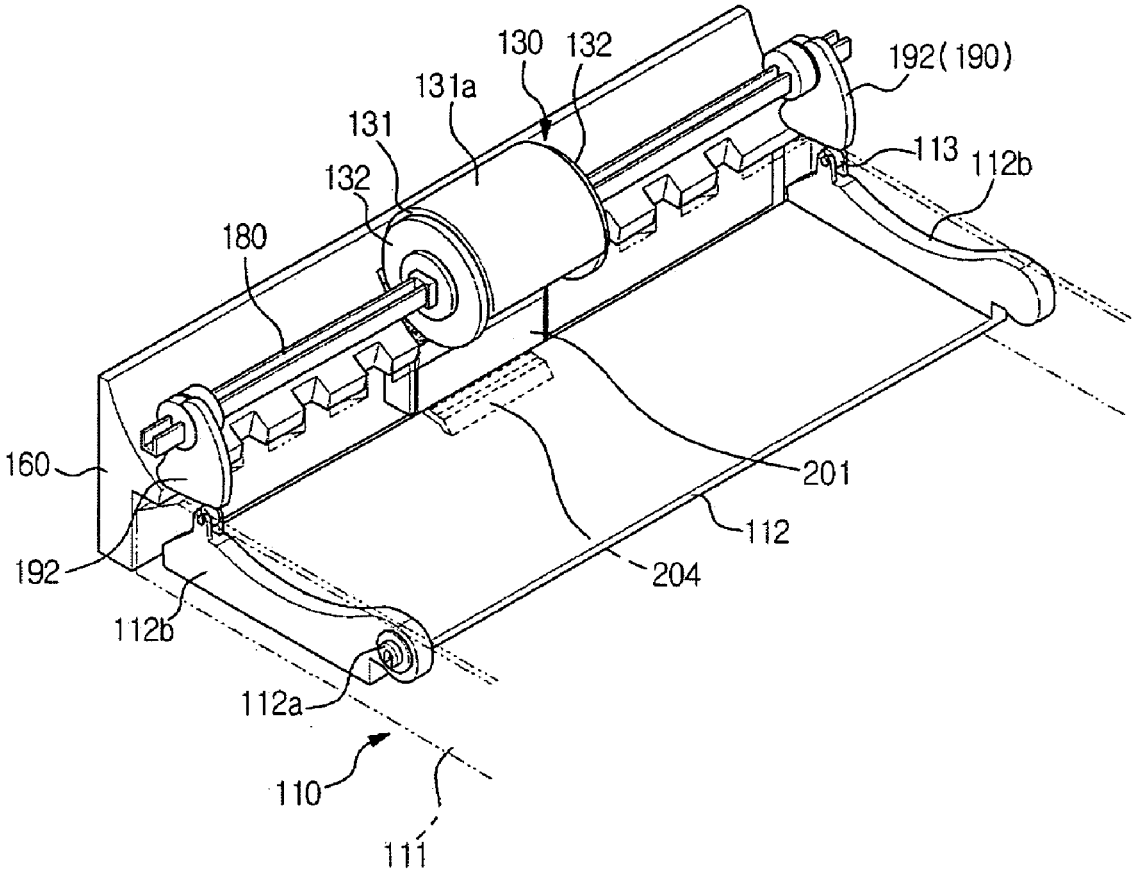
FIG. 5 is a perspective view illustrating relevant portions of the paper supply device of FIG. 4.
Figure 6:
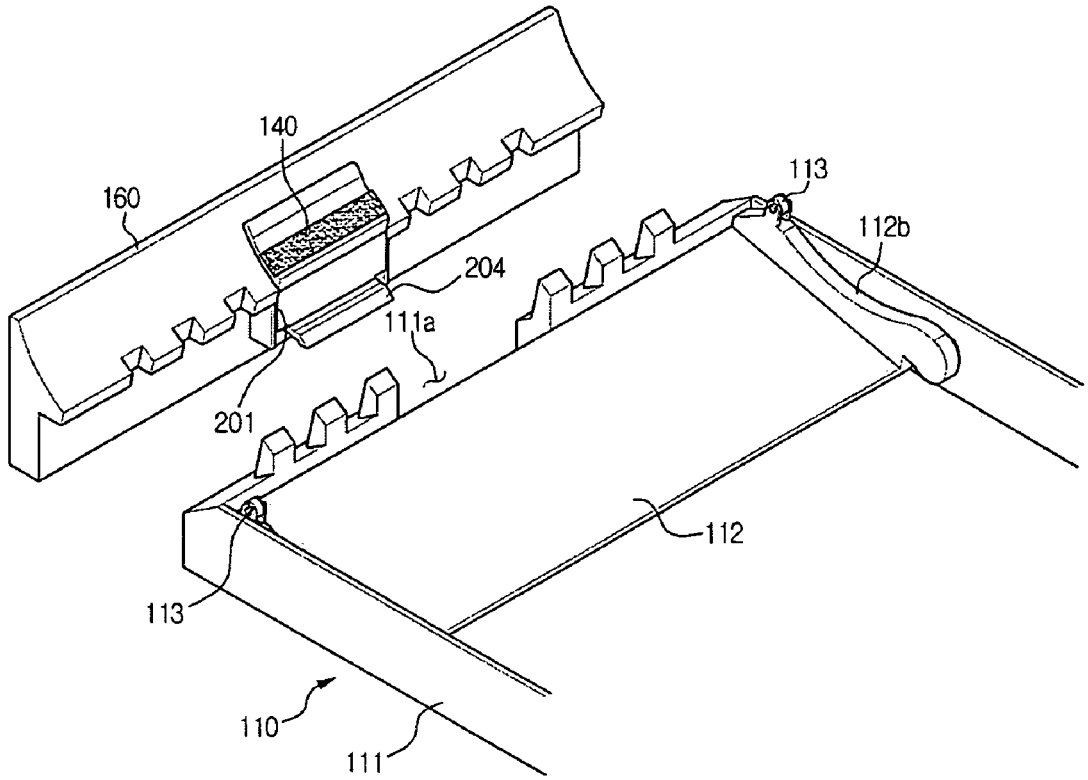
FIG. 6 is an exploded perspective view illustrating a paper supply cassette and a pickup guide according to an embodiment of the present invention.

FIG. 5 is a perspective view illustrating the configuration of the relevant portions of FIG. 4. FIG. 6 is a perspective view illustrating a paper supply cassette and a pickup guide according to an embodiment of the present invention.

As shown in FIGS. 3 to 5, the paper supply cassette 110 includes a cassette body 111 to receive paper, and a knockup plate 112 to support the first paper P1 loaded in the paper supply cassette 110.

The knockup plate 112 is rotatably supported in the cassette body 111. The knockup plate 112 is coupled to the cassette body 111 via a hinge shaft 112*a* provided at a trailing end thereof, and the leading end of the knockup plate 112 pivotally rotates to move in upward and downward direction.

The pickup roller 130 is located above the leading end of the knockup plate 112. The pickup roller 130 is installed on a shaft 180, which is rotatably supported by the body 10*a*. The shaft 180 rotates upon receiving power from a drive motor (not shown) provided in the body 10*a*.

The pickup roller 130 includes a pickup rotating member 131 to pick up the first paper P1 disposed on the knockup plate 112, and a pair of idle rollers 132 provided on both sides of the pickup rotating member 131 to freely rotate.

The pickup rotating member 131 includes a contact portion 131*a*, which is brought into contact with the first paper P1 during only a portion of the rotational period of the pickup rotating member 131. The contact portion 131*a* protrudes outward in a radial direction of the idle rollers 132. When the contact portion 131*a* of the pickup rotating member 131 comes into contact with the first paper P1 as shown in FIG. 3, the idle rollers 132 are spaced apart from the first paper P1. However, when the contact portion 131*a* of the pickup rotating member 131 does not come into contact with the first paper P1, the idle rollers 132 come into contact with the first paper P1.

The idle rollers 132 press the pickup pad 140 with a predetermined pressure when the first paper P1, picked up by the pickup rotating member 131, passes over the pickup pad 141 located at a first position. This allows only the uppermost sheet of the first paper P1 disposed on the knockup plate 112 to be delivered to the delivery roller 170.

The paper supply device 20 includes a lifter 190 to move the knockup plate 112 up and down. The lifter 190 includes an elastic member 191 to elastically bias the knockup plate 112 upward, and a pair of cams 192, which are coupled on both ends of the shaft 180 such that the pickup roller 130 is interposed therebetween, the cams 192 rotating together with the pickup roller 130.

The cams 192 press both sidewalls 112*b* of the knockup plate 112 for a specific duration of the rotating period of the shaft 180, thereby pivotally rotating the knockup plate 112 downward. Guide rollers 113 can be installed to both the sidewalls 112*b* of the knockup plate 112, to allow the cams 192 to efficiently press the knockup plate 112.

If the cams 192 are further rotated and thus, are spaced apart from the knockup plate 112, the knockup plate 112 is pivotally rotated upward by the elastic member 191.

As shown in FIGS. 3 to 6, the pickup guide 160 is installed at the rear side of the paper supply cassette 110. A pad holder 200 is installed, in a vertically movable manner, to the pickup guide 160 at a position corresponding to the pickup roller 130.

The pad holder 200 includes a holder body 201 to support the pickup pad 140, and an elastic member 202 to elastically bias the holder body 201 upward.

The holder body 201 is formed, at an upper end thereof, with a pad receiving portion 203 to receive the pickup pad 140. Also, the holder body 201 is formed, at a lower end thereof, with an interference piece 204 protruding toward the knockup plate 112. To allow the interference piece 204 to extend to the knockup plate 112, the cassette body 111 is formed with an opening 111*a*.

The interference piece 204 interferes with the leading end of the knockup plate 112 when the knockup plate 112 is pivotally rotated downward. Accordingly, the holder body 201 is moved downward in conjunction with the knockup plate 112 when the knockup plate 112 is pivotally rotated downward. As a result, the pickup pad 140 can be spaced apart from the pickup roller 130.

The elastic member 202 is installed between the holder body 201 and the pickup guide 160. If the knockup plate 112, which press the interference piece 204 of the holder body 201, is pivotally rotated upward, the holder body 201 is moved upward by an elastic force of the elastic member 202, thereby allowing the pickup pad 140 to come into contact with the pickup roller 130.

Figure 7:
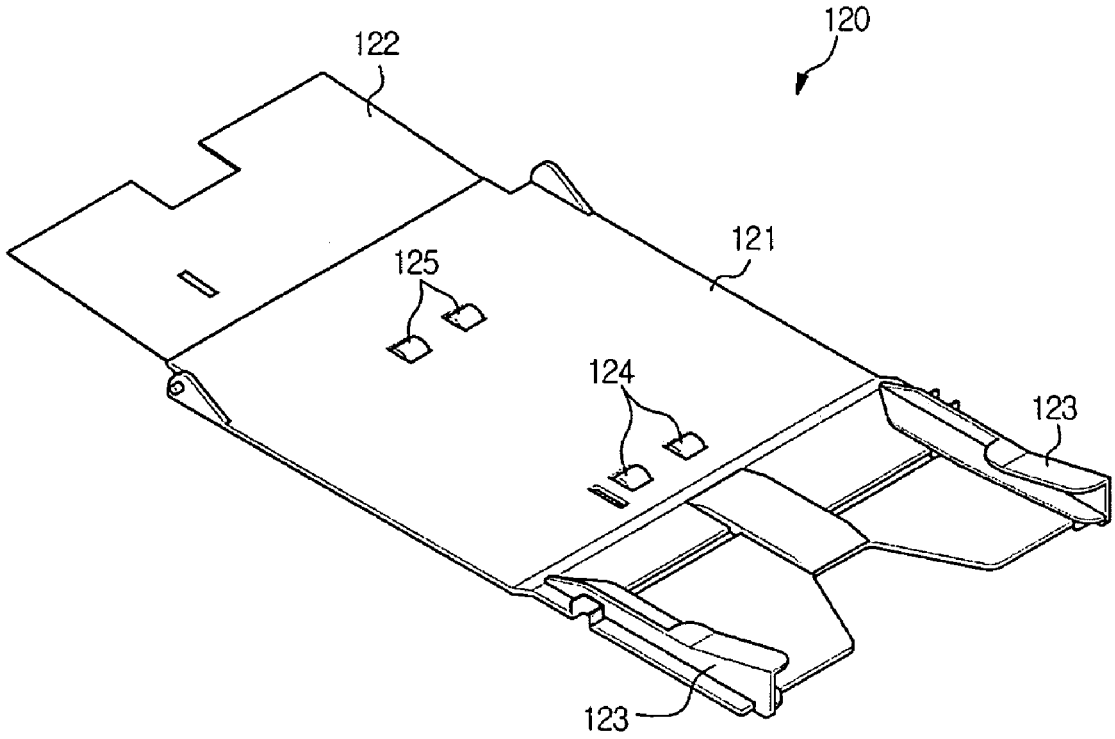
FIG. 7 is a perspective view illustrating a paper supply tray according to and embodiment of the present invention.

FIG. 7 is a perspective view of the paper supply tray according to an embodiment of the present invention.

As shown in FIGS. 4 to 7, the paper supply tray 120 includes a paper supply plate 121 fixedly mounted in the body 10*a*, a guide film 122 extending from an end of the paper supply plate 121 toward the pickup roller 130, and a pair of adjusting guides 123, which are movable left and right such that a distance therebetween coincides with a width of the second paper P2 disposed on the paper supply plate 121.

The at least one feed roller 150 is disposed on the paper supply plate 121. The feed roller 150 is rotatably installed in the body 10*a*, and rotates upon receiving power from a drive motor (not shown). In the present embodiment, the at least one feed roller 150 includes first and second feed rollers 151 and 152, but any number of the feed rollers can be appropriately provided to suit a particular design.

The paper supply plate 121 is provided with a first backup roller 124 and a second backup roller 125. The first backup roller 124 and second backup roller 125 are rotatably engaged with the first feed roller 151 and second feed roller 152, respectively, such that the second paper P2, disposed on the paper supply plate 121, is delivered to the delivery roller 170 by rotation thereof.

The guide film 122 may be made of a flexible material, and extends with a slant toward the bottom of the pickup roller 130 from the paper supply plate 121 mounted in the body 10*a*. In the present embodiment, the second paper P2 disposed on the paper supply tray 120 is not picked up by the pickup roller 130, but directly passes through the gap between the pickup roller 130 and the pickup pad 140 so as to be delivered to the delivery roller 170. Accordingly, if the guide film 122 is excessively tilted, a paper jam may occur in the vicinity of the pickup guide 160 where a paper delivery path has a steep gradient. Therefore, the tilt angle θ of the guide film 122 relative to a horizontal plane is preferably less than 3°.

The delivery roller 170 is arranged, together with a third backup roller 171, in the paper supply path 21 downstream of the pickup roller 130. The third backup roller 171 is rotatably engaged with the delivery roller 170, and delivers the paper by rotation thereof, and in conjunction with the delivery roller 170, to the transfer roller 72. In particular, in the case of the second paper P2 supplied from the paper supply tray 120, after being delivered to the delivery roller 170 by the first feed roller 151 and second feed roller 152, the paper P2 pauses between the delivery roller 170 and the third backup roller 171, so as to be delivered to the transfer roller 72 at the appropriate time.

The delivery roller 170 may be a registration roller 170*a* to align the first paper P1 supplied from the paper supply cassette 110 or the second paper P2 supplied from the paper supply tray 120.

A first paper sensor 211 may be provided at the front side of the first feed roller 151. If the first paper sensor 211 senses a leading end of the second paper P2 as the second paper P2 is supplied to the paper supply tray 120, a controller (not shown) of the image forming apparatus 10 drives the first feed roller 151 and second feed roller 152, to deliver the second paper P2.

A second paper sensor 212 is disposed between the second feed roller 152 and the pickup roller 130. The second paper sensor 212 is used to confirm normal delivery of the second paper P2 supplied from the paper supply tray 120. For example, if the second paper sensor 212 does not sense any paper after the first paper sensor 211 senses the paper, a paper jam may have occurred between the first paper sensor 211 and the second paper sensor 212.

A third paper sensor 213 is disposed between the pickup roller 130 and the delivery roller 170. As the third paper sensor 213 senses the paper to be introduced to the delivery roller 170, the controller (not shown) of the image forming apparatus controls the delivery roller 170 on the basis of the signal from the third paper sensor 213.

Hereinafter, an example of paper supply operation of the image forming apparatus according to the embodiment of the present invention will be described with reference to FIGS. 3 to 5.

In an idle state, i.e., waiting for a print operation, the cams 192 installed to the shaft 180 press the knockup plate 112 as shown in FIG. 5. Accordingly, the knockup plate 112 is kept in a downwardly pivotally rotated state. The pad holder 200, which cooperates with the knockup plate 112, is also kept in a downwardly moved state. As a result, the pickup pad 140, installed at the upper end of the pad holder 200, is spaced apart from the pickup roller 130 and is kept at the second position.

First, supply of the paper P1 from the paper supply cassette 110 will be described. If a printing command is inputted in the above-described idle state, the shaft 180 is rotated, causing the cams 192 to be spaced apart from the knockup plate 112. Thereby, the leading end of the knockup plate 112 is pivotally rotated upward by the elastic member 191 which elastically supports the knockup plate 112.

As the leading end of the knockup plate 112 is pivotally rotated upward, an uppermost sheet of the first paper P1 disposed on the knockup plate 112 is brought into contact with the pickup roller 130. Also, the holder body 201 of the pad holder 200 is moved upward by the elastic member 202, causing the pickup pad 140 to come into contact with the pickup roller 130.

If the pickup roller 130 is further rotated in the above-described state, the uppermost paper P1 is picked up by the pickup roller 130, and is delivered toward the delivery roller 170. In this case, the pickup pad 140 is pressed toward the pickup roller 130, to prevent simultaneous delivery of two sheets of paper.

Next, supply of the second paper P2 from the paper supply tray 120 will be described. If the second paper P2 is placed on the paper supply tray 120 in the above-described idle state, the first paper sensor 211 senses the leading end of the second paper P2.

If the first paper sensor 211 senses the second paper P2, the controller (not shown) of the image forming apparatus 10 controls a drive motor (not shown) such that no power is applied to the shaft 180. Thus, the cams 192 continue pressing the knockup plate 112, the pad holder 200 is in a downwardly moved state, and the pickup pad 140 is spaced apart from the pickup roller 130 to maintain a gap G between the pickup pad 140 and the pickup roller 130.

As the first feed roller 151 and second feed roller 152 rotate in the above-described state, the second paper P2 disposed on the paper supply plate 121 is delivered to the guide film 122, and is introduced into the gap G between the pickup roller 130 and the pickup pad 140 by guidance of the guide film 122. In this case, even if paper is caught between the pickup roller 130 and the pickup pad 140, the gap G between the pickup roller 130 and the pickup pad 140 can prevent simultaneous delivery of two sheets of paper toward the printing device 30.

The second paper P2, having passed through the gap G between the pickup roller 130 and the pickup pad 140, is delivered to the delivery roller 170 by the first feed roller 151 and second feed roller 152.

If the third paper sensor 213 senses the leading end of the second paper P2 as the second paper P2 accesses the delivery roller 170, the controller of the image forming apparatus 10 controls the delivery roller 170 such the delivery roller 170 rotates after a first predetermined time t1 elapses, and stops after a second predetermined time t2 elapses (t2>t1).

The second paper P2 is continuously delivered by the feed rollers 151 and 152 for the first predetermined time t1, but the delivery roller 170 is not rotated for the first predetermined time t1. Thereby, the leading end of the second paper P2 delivered to the delivery roller 170 is caught and aligned by the delivery roller 170.

If the delivery roller 170 rotates after the first predetermined time t1 elapses, the leading end of the second paper P2 aligned by the delivery roller 170 is introduced into a gap between the delivery roller 170 and the third backup roller 171.

Subsequently, if the delivery roller 170 stops after the second predetermined time t2 elapses, the leading end of the second paper P2 is kept in a waiting state in which it is caught between the delivery roller 170 and the third backup roller 171, so as to be delivered toward the transfer roller 72 at the appropriate time.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a body housing therein a printing device;

a first paper supply unit configured to receive first paper;

a second paper supply unit configured to receive second paper;

at least one feed roller configured to deliver the second paper disposed on the second paper supply unit;

a pickup roller to pick up the first paper from the first paper supply unit;

a pickup pad selectively moveable between a first position and a second position, the pickup pad pressing against the pickup roller when in the first position, the pickup pad being spaced apart from the pickup roller when in the second position, the pickup pad being configured to be in the first position when the pickup roller picks up the first paper from the first paper supply unit, the pickup pad being configured to be in the second position when the second paper disposed on the second paper supply unit is delivered by the feed roller; and a delivery roller arranged between the pickup roller and the printing device, wherein the second paper is delivered by the feed roller to the delivery roller through a gap between the pickup roller and the pickup pad, the delivery roller delivering the second paper toward the printing device, wherein the delivery roller is a registration roller configured to align the paper supplied from any one of the first paper supply unit and the second paper supply unit.

2. The image forming apparatus according to claim 1, wherein the first paper supply unit comprises a paper supply cassette detachably mounted to the body, the second paper supply unit comprises a paper supply tray mounted in the body, and the paper supply tray is located above and in proximity to the paper supply cassette.

3. The image forming apparatus according to claim 1, wherein the first paper supply unit includes a knockup plate, which is pivotally moveable up and down, and the pickup pad moves between the first position and the second position in cooperation with the knockup plate.

4. The image forming apparatus according to claim 3, further comprising:

a pad holder configured to support the pickup pad, the pad holder including an interference piece to interfere with at least a portion of the knockup plate.

5. The image forming apparatus according to claim 4, wherein the pad holder further comprises:

a holder body having formed, at an upper end thereof, a pad receiving portion; and an elastic member configured to elastically bias the holder body upward toward the pickup roller.

6. The image forming apparatus according to claim 4, further comprising:

a pickup guide arranged downstream of the first paper supply unit along a paper path in which the first paper picked up by the pickup roller travels, the pickup guide being configured to guide any of the first paper supplied from the first paper supply unit and the second paper supplied from the second paper supply unit, wherein the pad holder is installed, in a vertically movable manner, to the pickup guide.

7. The image forming apparatus according to claim 3, further comprising:

a cam located configured to interfere with an upper side of the knockup plate so as to pivotally rotate the knockup plate downward.

8. The image forming apparatus according to claim 1, wherein the at least one feed roller includes a first feed roller, and wherein the second paper supply comprises a first paper sensor arranged upstream of the first feed roller with respect to a direction of travel of the second paper.

9. The image forming apparatus according to claim 8, wherein, upon sensing by the first paper sensor senses of the second paper, the first feed roller rotates to deliver the second paper disposed on the second paper supply unit to the delivery roller.

10. The image forming apparatus according to claim 8, wherein the at least one feed roller further includes a second feed roller arranged downstream of the first feed roller, and wherein the second paper supply further comprises a second paper sensor installed between the second feed roller and the pickup roller.

11. The image forming apparatus according to claim 10, further comprising:

a third paper sensor arranged between the pickup roller and the delivery roller.

12. An image forming apparatus, comprising:

a body housing therein a printing device;

a first paper supply unit detachably mounted to the body;

a second paper supply unit arranged proximate to, and above, the first paper supply unit;

a pickup roller to pick up paper from the first paper supply unit;

at least one feed roller to deliver paper disposed on the second paper supply unit;

a pickup pad selectively movable between a first position and a second position, the pickup pad being pressed against the pickup roller when in the first position, the pickup pad being spaced apart from the pickup roller when in the second position; and a delivery roller arranged between the pickup roller and the printing device, - wherein the paper, delivered by the feed roller from the second paper supply unit, passes through a gap between the pickup pad in the second position and the pickup roller to be delivered to the delivery roller, wherein the first paper supply unit includes a knockup plate pivotally rotatable to move upward and downward, and a pad holder including a holder body to support the pickup pad, wherein the pad holder further includes:

an interference piece to interfere with the knockup plate when the knockup plate is pivotally rotated downward; and an elastic member to elastically bias the holder body upward.

13. The image forming apparatus according to claim 12, wherein the image forming apparatus further comprises a lifter to move the knockup plate upward and downward, and the pickup pad moves from the first position to the second position in cooperation with the lifter and knockup plate.

14. A paper supply device usable in an image forming apparatus, comprising:

a knockup plate configured to support paper thereon, the knockup plate being pivotally rotatable so that one end of the knockup plate moves up and down;

a pickup roller to pick up paper supported on the knockup plate;

a pickup pad selectively movable between a first position and a second position, the pickup pad being pressed against the pickup roller when in the first position, the pickup pad being spaced apart from the pickup roller to form a gap therebetween, the pickup pad being in the first position when the paper supported on the knockup plate is being picked up and delivered to the image forming apparatus by the pickup roller, the pickup pad being in the second position when the paper supported on the knockup plate is not being picked up;

a cam rotatably supported on a shaft, the pickup roller rotating about the shaft, the cam being configured to interfere with the knockup plate so as to pivotally rotate the knockup plate downward away from the pickup roller; and a pad holder including a holder body to support the pickup pad and an interference protrusion to interfere with the knockup plate so that the pickup pad moves away from the pickup roller when the knockup plate is pivotally rotated downward away from the pickup roller; the pad holder further comprising an elastic member to elastically bias the holder body upward.

15. The paper supply device according to claim 14, further comprising:

a paper supply tray configured to support thereon a second supply of paper to be supplied to the image forming apparatus, the paper tray being arranged proximate to, and above, the knockup plate; and at least one feed roller to deliver the paper disposed on the paper supply tray to the image forming apparatus, the paper being conveyed by the at least one feed roller from the paper supply tray through the gap between the pickup pad and the pickup roller when the pickup pad is in the second position.

16. The paper supply device according to claim 15, further comprising:

a paper sensor arranged to sense presence of paper placed on the paper supply tray.

* * * * *